US006449904B1

(12) United States Patent
Paasonen

(10) Patent No.: US 6,449,904 B1
(45) Date of Patent: Sep. 17, 2002

(54) CLOSURE SEQUENCE CONTROL MECHANISM FOR A PAIR OF DOORS

(75) Inventor: Simo Paasonen, Naantali (FI)

(73) Assignee: Abloy Oy, Joensuu (FI)

( * ) Notice: Subject to any disclaimer, the term of this patent is extended or adjusted under 35 U.S.C. 154(b) by 0 days.

(21) Appl. No.: 09/047,133

(22) Filed: Mar. 24, 1998

(30) Foreign Application Priority Data

Mar. 26, 1997 (FI) ..... 971256

(51) Int. Cl.[7] ..... E05F 5/12
(52) U.S. Cl. ..... 49/103; 49/366; 49/367
(58) Field of Search ..... 49/103, 366, 367, 49/368

(56) References Cited

U.S. PATENT DOCUMENTS

| | | | | | |
|---|---|---|---|---|---|
| 3,822,506 | A | | 7/1974 | Fishbach | |
| 3,895,461 | A | * | 7/1975 | Maynard et al. | 49/367 |
| 4,262,448 | A | * | 4/1981 | Flider | 49/367 |
| 4,429,492 | A | | 2/1984 | Imhoff | |
| 4,583,324 | A | * | 4/1986 | Storz et al. | 49/367 |
| 4,619,076 | A | * | 10/1986 | Livingston | 49/367 |
| 4,653,229 | A | * | 3/1987 | Feucht et al. | 49/367 |
| 4,949,505 | A | * | 8/1990 | Cohrs | 49/367 |
| 4,967,512 | A | * | 11/1990 | Schroder et al. | 49/367 |
| 5,033,234 | A | * | 7/1991 | Simon et al. | 49/367 |
| 5,061,022 | A | * | 10/1991 | Meriwether | 312/324 |
| 5,582,472 | A | * | 12/1996 | Lyons et al. | 312/324 |
| 5,651,216 | A | * | 7/1997 | Tillmann | 49/367 |

FOREIGN PATENT DOCUMENTS

| | | | | |
|---|---|---|---|---|
| DE | 33 36 739 | | 4/1975 | |
| DE | 3336739 | * | 4/1985 | 49/367 |
| DE | 3 604 091 | | 8/1987 | |
| DE | 3941455 | * | 6/1990 | 49/367 |
| DE | 43 08 560 | | 9/1994 | |
| DE | 295 00 910 | | 7/1996 | |

* cited by examiner

*Primary Examiner*—Gregory J Strimbu
(74) *Attorney, Agent, or Firm*—John Smith-Hill; Smith-Hill and Bedell

(57) ABSTRACT

A first door closer unit and a first swing arm close a first door leaf of a pair of door leaves arid a second door closer unit and a second swing arm close the second door leaf of the pair. A guide rail supported by a door frame guides the distal ends of the swing arms. A closure sequence controller includes a control member in the guide rail between the distal ends of the swing arms and movable against the force of a spring, a support element stationarily supported by the guide rail, and a movable blocking member. The closure sequence controller is arranged in cooperation with the distal ends of the swing arms at the end phase of the closing movement of the door leaves so that the blocking member prevents movement in the guide rail of the distal end of the second swing arm until the distal end of the first swing arm acts on the blocking member through the control member go that the blocking member allows closing of the second door leaf. The blocking member is arranged in a guiding passage in the support element so that in its blocking position the blocking member extends partly out from the guiding passage into the path of movement of the distal end of the second swing arm.

14 Claims, 4 Drawing Sheets

CLOSURE SEQUENCE CONTROL MECHANISM FOR A PAIR OF DOORS

BACKGROUND OF THE INVENTION

The invention relates to a closure sequence control mechanism for a pair of turnable doors.

In order to lock a pair of doors to each other one of the door leaves is provided preferably with a latch bolt. As a consequence the door leaves must be closed in a certain order so that the door leaf provided with the latch bolt (hereinafter referred to as the second door leaf) is closed after the door leaf without the latch bolt (the first door leaf). The spring-loaded latch bolt then can be pressed, due to its bevelled guiding surface, into a lock housing in the second door leaf as the second door leaf is turned to its fully closed position. In this position the latch bolt can again move, urged by the spring, in to its protruding position, in which it locks the door leaves to each other. One closure sequence control mechanism suitable for the purpose is disclosed in the publication EP 0 458 034. This known solution is, however, constructionally complicated and the installation thereof is rather cumbersome.

SUMMARY OF THE INVENTION

An aim of the invention is to provide a closure sequence controller for a pair of turnable doors which ensures a desired order for the closing of the door leaves but which is constructionally simple and operationally reliable and which is further easy to install.

A further aim of the invention is to provide a closure sequence controller for a pair of doors which allows easy adaptation to door openings of different widths, and particularly to a substantially narrower door opening.

In accordance with the invention the blocking member is arranged in a guiding passage in the support element so that in its blocking position the blocking member extends partly out from the guiding passage into the path of movement of the end of the swing arm of the second door leaf. By means of this arrangement it can be ensured in a simple and reliable way that the first door leaf is closed before closing of the second door leaf.

In a favorable embodiment of the invention the support element has a guiding surface, which extends in the direction of the guide member and at which the guiding passage opens. The end of the control member at the side of the support element comprises with advantage a guiding element provided with a holder member, which cooperates with the guide member and with the guiding surface of the support element. When the door leaves are open the holder member is arranged, under the influence of the spring, at the position of the guiding passage to prevent movement of the blocking member to its releasing position.

Further the guiding element may have a guiding surface parallel with the guiding surface of the support element and located at a distance from it and allowing movement of the blocking member into its releasing position but preventing, however, movement of the blocking member completely out of the guiding passage.

The holder member comprises with advantage a separate spring-loaded holder piece. A construction of this kind serves as an overload clutch, which protects the mechanism from being damaged for instance in case of misuse. The force affecting the door leaf and releasing the clutch is then dependent on the strength of the spring in the clutch.

The control member can with advantage comprise an elongated arm member, which is detachably, for instance by threads, mounted at its ends on the one hand to the guiding element and on the other hand to a counter piece, which is arranged in cooperation with the end of the swing arm of the door closer of the first door leaf. Such an arrangement is constructionally simple and allows the effective length of the arm member to be adjusted, so that the closure sequence controller can be applied to door openings of different widths. The closure sequence controller can be applied to substantially narrower pairs of doors when necessary by shortening the arm member, for instance through truncation.

In practice the blocking member is with advantage a ball.

BRIEF DESCRIPTION OF THE DRAWINGS

In the following the invention is described, by way of example, with reference to the attached drawings, in which.

DETAILED DESCRIPTION

Figure 1:
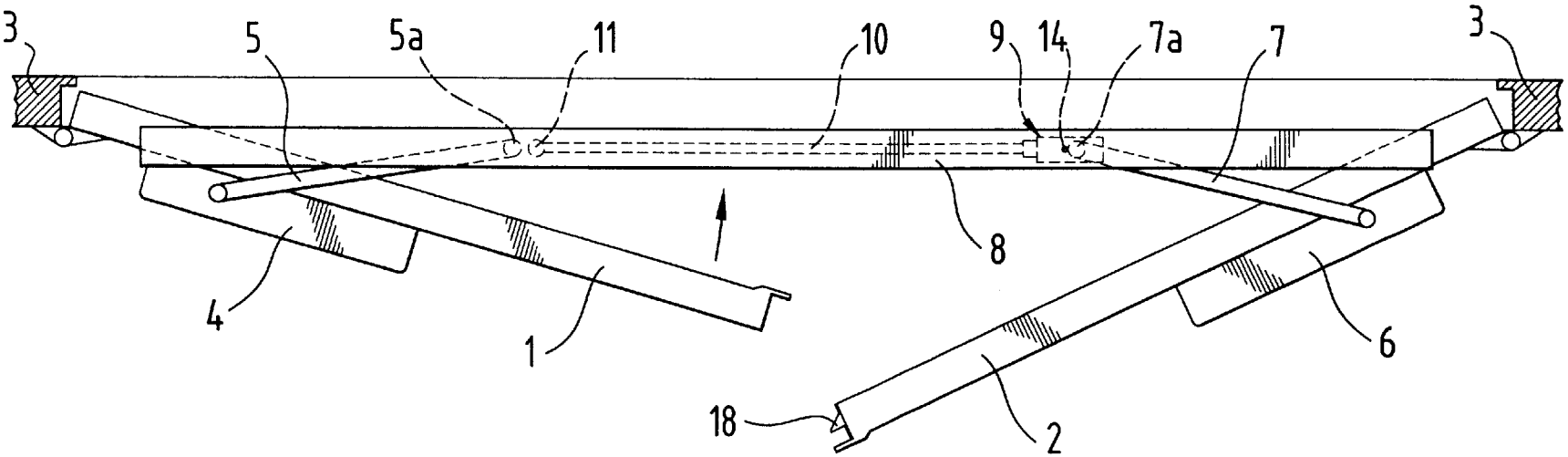
FIG. 1 shows schematically a door closing arrangement according to the invention for a turnable pair of doors viewed from above and the door leaves open in a position in which the closure sequence control mechanism is activated to determine the closing order of the door leaves.
Figure 2:
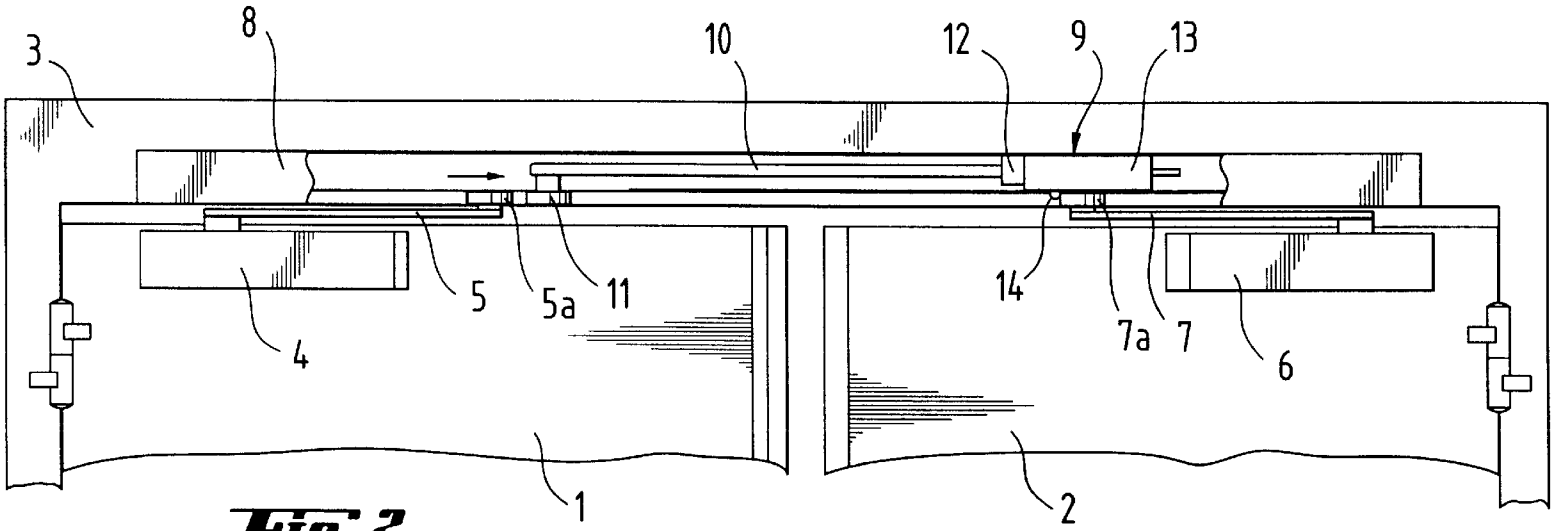
FIG. 2 shows the arrangement of FIG. 1 as a side view and partly in section.

In the drawings 1 and 2 indicate the two door leaves of a pair of doors, which are turnably journalled to a door frame 3. The first door leaf 1 is provided with a door closer 4 having a swing arm 5 and the second door leaf 2 is correspondingly provided with a door closer 6 having a swing arm 7. A guide rail 8 is supported to the door frame 3 (not shown m ore closely) above the door leaves. The guide rail 8 guides the ends 5*a* and 7*a* of the swing arms 5 and 7 to move along linear paths during the turning movements of the door leaves. The door leaf 2 is provided with a latch bolt 18. In case the door leaf 2 were allowed to close before the door leaf 1, the latter could not turn past the door leaf 2 and the latch bolt 18 into its closed position, in which the latch bolt 18 locks the door leaves to each other. The guide rail 8 is provided with a sequence control mechanism 9, which ensures that the door leaf 2 closes only after closing of the door leaf 1.

The closure sequence control mechanism 9 includes a control member, which comprises an arm member 10, one end of which is connected to a counter piece 11 and the other end is connected to a guiding element 12. The counter piece 11 is positioned in the channel defined by the guide rail to cooperate with the end 5*a* of the swing arm of the door closer 4. The guiding element 12 is in cooperation with a support element 13 fixed to the guide rail 8. The support element 13 has a guiding surface 13*a*. The guiding element 12 includes an extension shoulder 12*a*, which together with the guiding surface 13*a* of the support element 13 and the inner surface of the guide rail 8 guides movement of the element 12 and the arm member 10 parallel to the guide rail 8.

A guiding passage 13*b*, which contains a blocking member 14, opens at the guiding surface 13*a*. The guiding passage 13*b* is so designed that the blocking member 14 can protrude from it into the position shown in FIG. 3 in which it prevents movement along the guide rail 8 of the end 7*a* of the swing arm of the door closer of the second door leaf 2 and thereby prevents turning of the door leaf 2 itself further toward its fully closed position.

Figure 3:
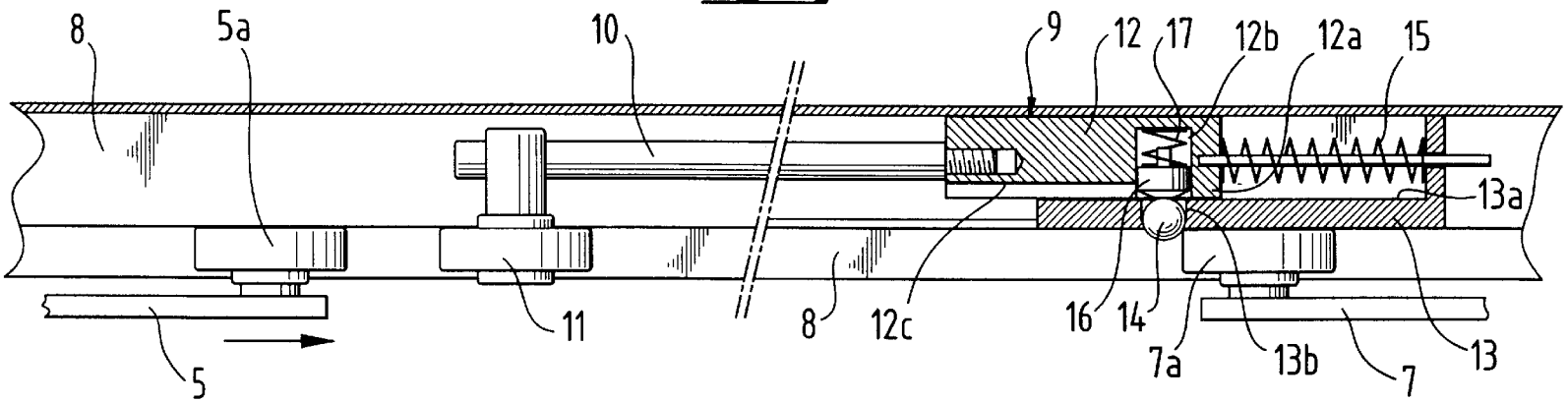
FIG. 3 shows a partial enlargement of the closure sequence control mechanism of FIG. 2.
Figure 4:
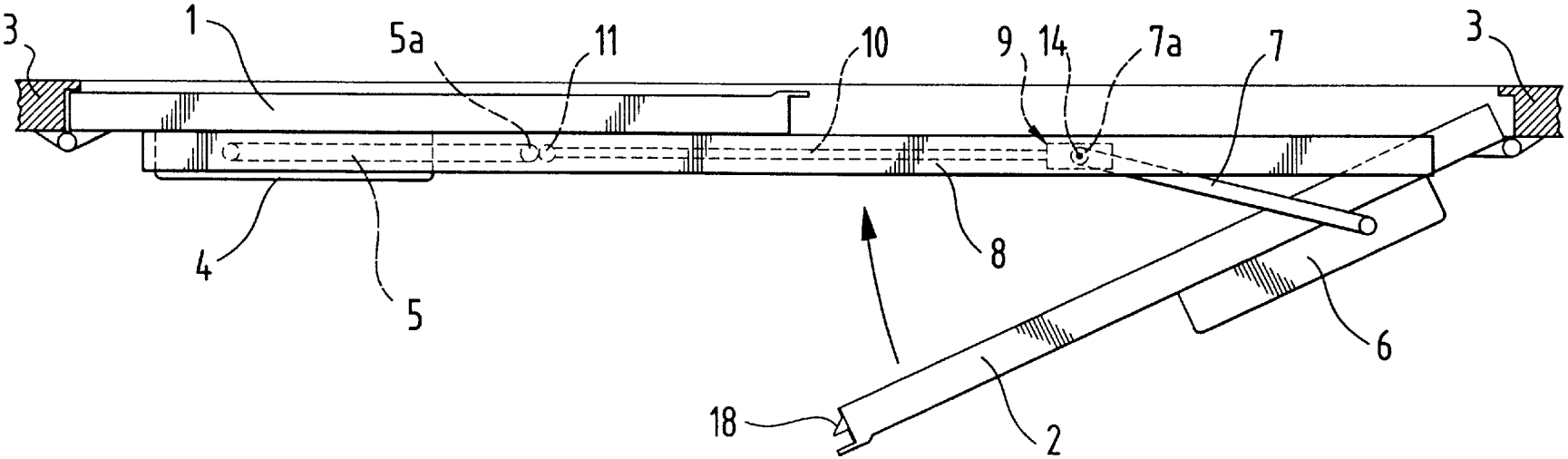
FIG. 4 shows the arrangement of FIG. 1 in a situation in which the first door leaf is closed and the closure sequence control mechanism is in a position allowing closing of the second door leaf.
Figure 5:
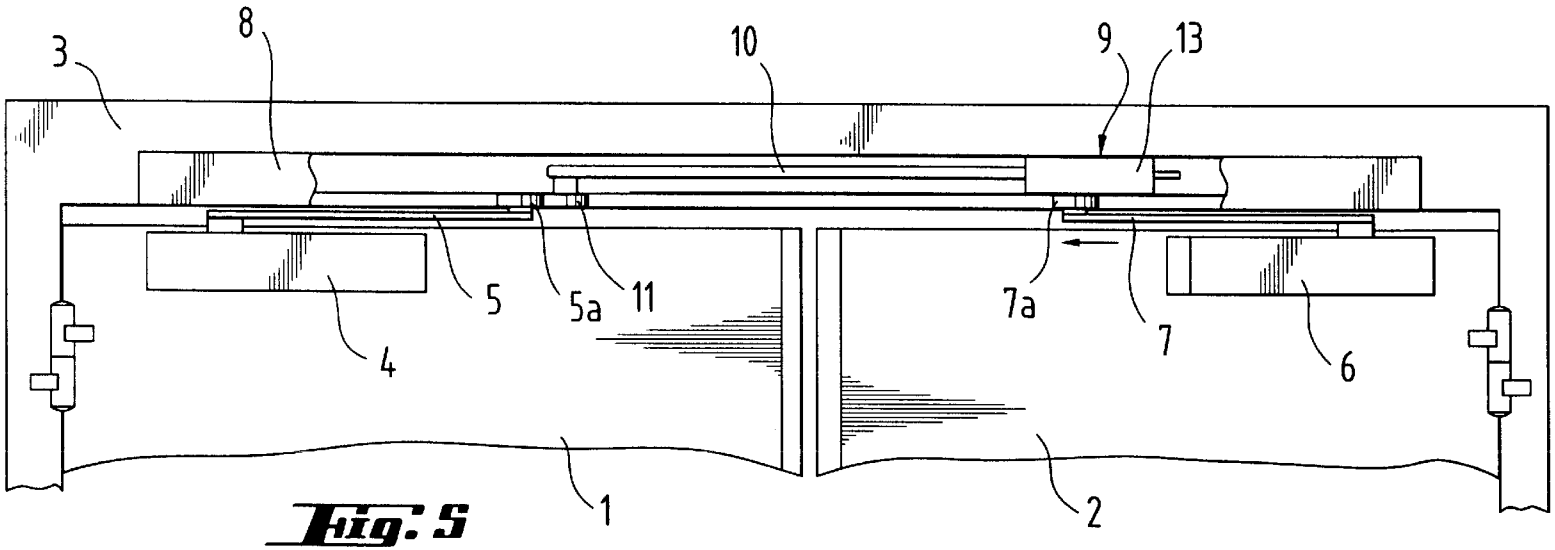
FIG. 5 shows the arrangement of FIG. 4 as a side view and partly in section.

The guiding element 12 includes also a bore 12*b* containing a holder piece 16 serving as a holder member, which together with a spring 17 urges the blocking member 14 toward its protruding position when the guiding element 12 is at the position shown in FIG. 3.

Figure 6:
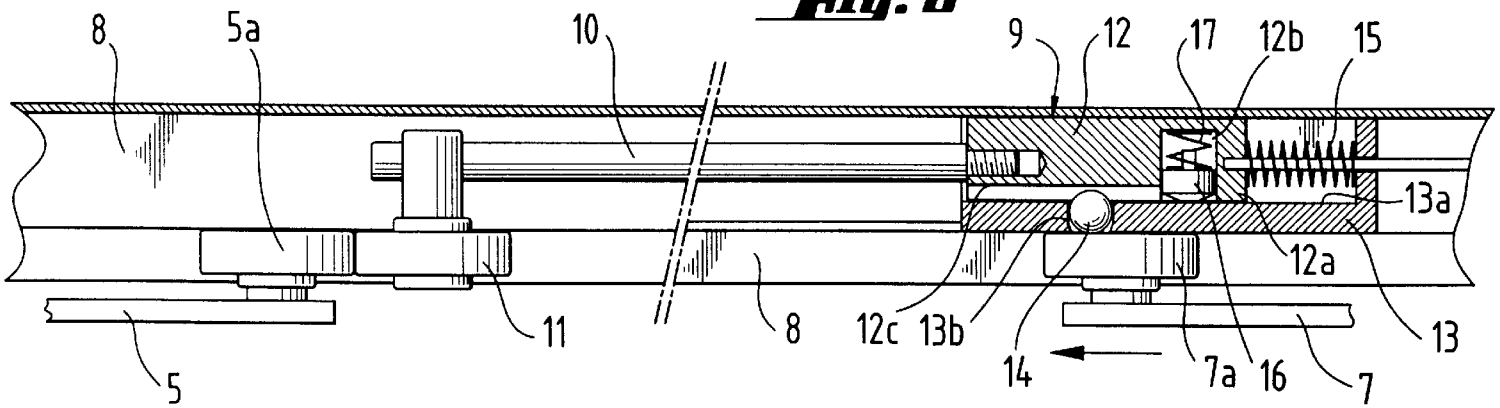
FIG. 6 shows a partial enlargement of the closure sequence control mechanism of FIG. 5.

When the door leaves are open a spring 15 effective between the guiding element 12 and the support element 13 forces the guiding element 12 to the position shown in FIG. 3, in which the holder piece 16 is at the position of the blocking member 14 as shown in FIG. 3. In addition the guiding element 12 has a recess or groove limited by a guiding surface 12*c*, parallel with and spaced apart from the guiding surface 13*a* of the support element 13. When the guiding element 12 is at the position shown in FIG. 6, and the holder piece 16 is away from the position of the blocking member 14, the blocking member 14 is able to move upward in the guiding passage 13*b*, partly into the recess limited by the surface 12*c*, into a position releasing the end 7*a* of the swing arm of the door closer in the second door leaf 2. However, the blocking member 14 remains captive in the guiding passage 13*b* due to the proximity of the surface 12*c*.

The operation of the closure sequence control mechanism is as follows. If both the door leaves 1 and 2 are in the open position and one tries to close the second door leaf 2 without first having closed the door leaf 1, the guiding element 12 is at the position shown in FIG. 3 and therefore the blocking member 14 is forced by the spring loaded holder piece 16 to protrude from the guiding passage 13*b*. The door leaf 2 turns until the end 7*a* of its swing arm 7 hits the blocking member 14 protruding partly out from the guiding passage 13*b*. The holder piece 16 resists movement of the blocking member 14 into its releasing position, so the door leaf 2 remains in the turning position in question. This corresponds in general to an opening angle of 20°, but the opening angle can in this case be quite as well for instance about 20°–30°.

Thus, in order to close the door leaf 2 one must first turn the first door leaf 1 so that the end 5*a* of its swing arm 5 hits the counter piece 11 located at the end of the arm member 10. When the door leaf 1 is turned further toward its closed position, the end 5*a* presses the control member against the force of the spring 15 arranged between the guiding element 12 and the support element 13 into the position shown in FIG. 6, in which the holder piece 16 has been moved away from the position of the blocking member 14, whereby the blocking member 14 is allowed to move partly out from the guiding passage 13*b* toward the guiding surface 12*c*, thereby releasing the end 7*a* of the swing arm 7. Now the door closer 6 can turn the door leaf 2 to its fully closed position, in which the latch bolt 18 locks the door leaves 1 and 2 to each other.

The extension shoulder 12*a* of the guiding element 12 may serve the same function as the spring-loaded holder piece 16 as regards preventing the blocking member from moving to its releasing position when the guiding element 12 is in the position shown in FIG. 3, whereby the extension shoulder 12*a*, if extended sufficiently to the left of FIG. 3 to cover the passage 13*b*, could replace entirely the holder piece 16 and the spring 17. In practice, however, the separate holder piece 16 and the spring 17 serve also as an overload clutch to prevent the construction from being damaged. If a strong enough closing force is exerted on the door leaf 2, the end 7*a* of the swing arm 7 acting on the blocking member 14 forces the holder piece 16 upward against the force of the spring 17 so that the end 7*a* of the swing arm 7 is able to move in the guide rail 8 past the blocking member 14. In practice the door leaf 2 may reach its closed position before the door leaf 1, in which case the door leaf 1 cannot be turned to its fully closed position past the latch bolt 18 in the door leaf 2. The door leaf 2 must first be reopened to allow the door leaf 1 to turn to its fully closed position.

On the other hand an overload clutch may also be advantageous when the door leaves are being opened. If for instance both the door leaves 1 and 2 are first opened slightly and thereafter the first door leaf 1 is fully opened, the sequence control mechanism 9 is in the position shown in FIG. 3. If the door leaf 2 has remained only slightly open, the end 7*a* of the swing arm 7 may be located on the left side of the blocking member 14 as seen in FIG. 3. In this case, the door leaf 2 can be opened more fully by utilizing a turning force sufficient to overcome the force of the spring 17 in the overload clutch. If there were no overload clutch, it would be necessary to close the door leaf 1 entirely and then open the door leaf 2.

As is apparent from the figures the blocking member 14 may with advantage be for instance a ball, especially a steel ball, whereby it constitutes a simple standard product. Naturally the blocking member 14 may also have another shape, for instance an elongated one, and when necessary it may have a recess for receiving the end 7*a* of the swing arm.

Correspondingly the end 7*a* of the swing arm 7 and at least the part of the support element 13 formed with the guiding passage 13*b* should be made of a hard and wear resistant material, for instance of hardened steel.

The illustrated mechanism employs a one-part uniform rail 8. In principle the guide rail could as well be made for instance of two parts so that the counter piece 11 and the guiding element 12 are located in separate guide rail segments.

If the arm member 10 is mounted detachably for instance by threads at its ends to the counter piece 11 and/or to the guiding element 12, the operative length of the arm member 10 can be adjusted. Therefore, a given closure sequence control mechanism can be adjusted so that it can be used with a range of door openings having different widths, and the corresponding door leaves. If the two ends of the arm member 10 are connected to the counter piece 11 and the guiding element 12 by threads of opposite respective hands, the distance between the counter piece 11 and the guiding element 12 can be adjusted by turning the arm member 10 using a suitable tool. Further, when necessary the arm member 10 may also be truncated, i.e. cut to a smaller length, when adapting the arrangement according to the invention to a pair of doors of significantly smaller width. Also the support element 13 may, when desired, be detachably mounted to the guide rail 8, for instance by screws, so that by changing the location of the screws one can simultaneously change the very opening angle of the door leaves at which the sequence control mechanism is activated.

So the invention is not limited to the embodiment shown, but several modifications are feasible within the scope of the attached claims.

What is claimed is:

1. A closure sequence controller for a pair of first and second door leaves pivotable with respect to a door frame, in which the first door leaf is provided with a first door closer and a first swing arm for closing the first door leaf and the second door leaf is provided with a second door closer and a second swing arm for closing the second door leaf, and the closure sequence controller comprises:

a guide member for mounting to the door frame in cooperative engagement with distal ends of the swing arms respectively, such that closing movement of each said door leaf is accompanied by movement of said distal end of its swing arm along the guide member toward said distal end of the other swing arm, a support element stationarily attached to the guide member, the support element being formed with a guiding passage, a blocking member displaceable in the guiding passage between a blocking position, in which the blocking member projects partially from the guiding passage where the blocking member is adapted to limit movement of said distal end of the second swing arm along the guide member, and a releasing position in which said blocking member is adapted to allow movement of said distal end of the second swing arm along the guide member, a control member extending along the guide member, movable lengthwise of the guide member, having a first end positioned to be engaged by said distal end of the first swing arm and adapted to be urged by said distal end of the first swing arm along the guide member from a first position to a second position when the first door leaf pivots toward its closed position, and the control member also having a second end in cooperative engagement with the support element, and in its first position, the control member prevents the blocking member from moving from said blocking position to said releasing position and in its second position, the control member allows the blocking member to move from said blocking position to said releasing position, and a spring interposed between the control member and the support element and resisting movement of the control member along the guide member from the first position towards the second position.

2. A closure sequence controller according to claim 1, wherein the support element has a guiding surface which extends lengthwise of the guide member and in which the guiding passage opens, and the control member at its second end has a guiding element which cooperates with the guide member and the guiding surface of the support element so that when the control member is in its first position, the guiding element prevents the blocking member from moving from its blocking position to its releasing position.

3. A closure sequence controller according to claim 2, wherein the guiding element includes a shoulder portion which prevents the blocking member from moving from its blocking position to its releasing position when the control member is in its first position.

4. A closure sequence controller according to claim 2, wherein the guiding element comprises a guiding element body and includes a holder member in cooperating engagement with the guiding element body and positioned to prevent the blocking member from moving from its blocking position to its releasing position when the control member is in its first position.

5. A closure sequence controller according to claim 4, comprising a spring effective between the holder member and the guiding element body for urging the holder member toward the guiding surface of the support element.

6. A closure sequence controller according to claim 2, wherein the guiding element has a guide surface in spaced parallel confronting relationship with the guiding surface of the support element, said guide surface allowing movement of the blocking member from its blocking position to its releasing position when the control member is in its second position while retaining the blocking member captive in the guiding passage.

7. A closure sequence controller according to claim 2, wherein the control member includes an elongate arm which is detachably mounted at one end to the guiding element.

8. A closure sequence controller according to claim 7, wherein the control member includes a counter piece at its first end for engagement by the distal end of the first swing arm when the first door leaf pivots toward said closed position, and wherein the elongate arm is detachably mounted to the counter piece.

9. A closure sequence controller according to claim 7, wherein the elongate arm is in threaded engagement with the guiding element.

10. A closure sequence controller according to claim 1, wherein the support element has an upper guiding surface extending lengthwise of the guide member and in which the guiding passage opens and the control member includes a guiding element positioned above the upper guiding surface of the support element and restrained against perpendicular movement away from the upper guiding surface of the support element, and wherein the guiding element has a lower surface formed with a groove extending lengthwise of the guide member and having a depth greater than an extent of the blocking member extending above the upper guiding surface of the support element when said blocking member is in said releasing position.

11. A closure sequence controller for a first door leaf and a second door leaf each being pivotable with respect to a door frame, wherein the first door leaf is provided with a first door closer and a first swing arm for closing the first door leaf and the second door leaf is provided with a second door closer and a second swing arm for closing the second door leaf, the closure sequence controller comprises:

a guide member for mounting to the door frame and for engaging a distal end of each of the swing arms, such that closing movement of each said door leaf is accompanied by movement of said distal end of its swing arm along the guide member toward said distal end of the other swing arm, a support element stationarily attached to the guide member, the support element being formed with a guiding passage, a blocking ball displaceable in the guiding passage between a blocking position, in which the blocking ball projects partially from the guiding passage where the blocking ball is adapted to limit movement of said distal end of the second swing arm along the guide member, and a releasing position in which the blocking ball is adapted to allow movement of said distal end of the second swing arm along the guide member, a control member extending along the guide member, movable lengthwise of the guide member, having a first end positioned to be engaged by said distal end of the first swing arm and adapted to be urged by said distal end of the first swing arm along the guide member from a first position to a second position when the first door leaf pivots toward its closed position, and the control member also having a second end in cooperative engagement with the support element, and in its first position, the control member prevents the blocking ball from moving from said blocking position to said releasing position and in its second position, the control member allows the blocking ball to move from said blocking position to said releasing position, and a spring resisting movement of the control member along the guide member.

12. A closure sequence controller according to claim 11, wherein the support element has an upper guiding surface extending lengthwise of the guide member and in which the guiding passage opens, the guiding passage opens in a lower surface of the support element in a circular aperture having a smaller diameter than the blocking ball, the control member includes a guiding element positioned above the upper guiding surface of the support element and restrained against perpendicular movement away from the upper guiding surface of the support element, and the guiding element has a lower surface formed with a groove extending lengthwise of the guide member and having a depth less than the diameter of the blocking ball.

13. A door installation including:

a door frame, a first door leaf and a second door leaf each being pivotable with respect to the door frame, a first door closer and a first swing arm for closing the first door leaf, a second door close; and a second swing arm for closing the second door leaf, and a closure sequence controller which comprises:

a guide member mounted to the door frame in cooperative engagement with a distal end of each of the swing arms, such that closing movement of each said door leaf is accompanied by movement of said distal end of its swing arm along the guide member toward said distal end of the other swing arm, a support element stationarily attached to the guide member, the support element being formed with a guiding passage, a blocking member displaceable in the guiding passage between a blocking position, in which the blocking member projects partially from the guiding passage into a path of movement of said distal end of the second swing arm and limits movement of said distal end of the second swing arm along the guide member, and a releasing position in which said blocking member allows movement of said distal end of the second swing arm along the guide member, a control member extending along the guide member, movable lengthwise thereof and having a first end positioned to be engaged by said distal end of the first swing arm when the first door leaf pivots toward its closed position for urging the control member along the guide member from a first position to a second position, and said control member having a second end in cooperative engagement with the support element, wherein in its first position the control member prevents the blocking member from moving from said blocking position to said releasing position and in its second position the control member allows the blocking member to move from said blocking position to said releasing position, and a spring interposed between the control member and the support element and resisting movement of the control member along the guide member from the first position towards the second position.

14. A door installation according to claim 13, wherein the blocking member is a ball.

* * * * *

UNITED STATES PATENT AND TRADEMARK OFFICE

CERTIFICATE OF CORRECTION

PATENT NO. : 6,449,904 B1
DATED : September 17, 2002
INVENTOR(S) : Simo Paasonen It is certified that error appears in the above-identified patent and that said Letters Patent is hereby corrected as shown below:

Column 7,
Line 24, "close;" should be deleted and replaced with -- closer --.

Signed and Sealed this

Twenty-eighth Day of January, 2003

JAMES E. ROGAN
*Director of the United States Patent and Trademark Office*